United States Patent [19]

Matsumoto

[11] Patent Number: 4,917,032

[45] Date of Patent: Apr. 17, 1990

[54] METHOD AND APPARATUS FOR CHANGING THE SEWING DIRECTION OF A MULTIPLE NEEDLE FLAT SEAM STITCH MACHINE

[75] Inventor: Takeshi Matsumoto, Toyonaka, Japan

[73] Assignee: Yamato Mishin Seizo Kabushiki Kaisha, Osaka, Japan

[21] Appl. No.: 293,007

[22] Filed: Jan. 3, 1989

[30] Foreign Application Priority Data

Jul. 26, 1988 [JP] Japan ..... 63-185875

[51] Int. Cl.[4] ..... D05B 1/08

[52] U.S. Cl. ..... 112/262.3; 112/165; 112/197; 112/260; 112/303

[58] Field of Search ..... 112/165, 262.3, 303, 112/260, 197

[56] References Cited

U.S. PATENT DOCUMENTS 3,513,797 5/1970 Hagemeyer ..... 112/260

3,715,643 2/1973 Masaki .

4,407,210 10/1983 Jung et al. ..... 112/260

FOREIGN PATENT DOCUMENTS 1933678 1/1971 Fed. Rep. of Germany ..... 112/260

*Primary Examiner*—Andrew M. Falik

*Attorney, Agent, or Firm*—Wenderoth, Lind & Ponack

[57] ABSTRACT

A method and an apparatus for changing the sewing direction of a multiple needle flat sewing machine for sewing elbow pads of sports wear, jumpers, etc. and patchworks of various shapes. Needles are stopped at the needle upper dead center position; a throat plate is moved in a direction contrary to the sewing direction; a needle thread or looper thread caught on tongues of the throat plate is released from the tongues; and the sewing direction can be changed at any desired angle in relation to the sewing direction at the start, such as a right angle, an acute angle or an obtuse angle. The present invention also makes it possible to carry out fancy stitching with thick thread by a multiple needle flat sewing machine.

3 Claims, 5 Drawing Sheets

METHOD AND APPARATUS FOR CHANGING THE SEWING DIRECTION OF A MULTIPLE NEEDLE FLAT SEAM STITCH MACHINE

BACKGROUND OF THE INVENTION

1. Field of the Invention:

This invention relates to a method and an apparatus for changing the sewing direction of a multiple needle flat sewing machine, especially for patchworks.

2. Description of the prior art:

The conventional multiple needle flat sewing machine has a throat plate of a fixed type and therefore the needle thread, looper thread or the like caught by tongues of the throat plate cannot be released from the tongues. Thus, it has been impossible for the conventional multiple needle flat sewing machine to change the sewing direction, in the course, of a sewing operation, at a desired angle, such as a right angle, an acute angle or an obtuse angle for patchworks, for example.

SUMMARY OF THE INVENTION

It is recently the fashion to sew a different material on the surface of elbows, for example, of an outerwear garment to present a reinforcement-line appearance.

An object of the present invention is to provide a method and an apparatus for carrying out sewing of patchworks to meet such fashion standard and also fancy stitching on a multiple needle flat sewing machine. In the present invention, a throat plate is movable in a direction contrary to the sewing direction when sewing needles are at the upper dead center point and therefore sewing thread caught by tongues of the throat plate is released from the tongues, whereby a material being sewn can be changed in a desired sewing direction. Thus, the above-mentioned patchworks can be sewn easily and freely on a sewing machine.

BRIEF DESCRIPTION OF THE DRAWINGS

The accompanying drawings show an embodiment of the present invention, in which.

DETAILED DESCRIPTION OF THE INVENTION

Figure 1:
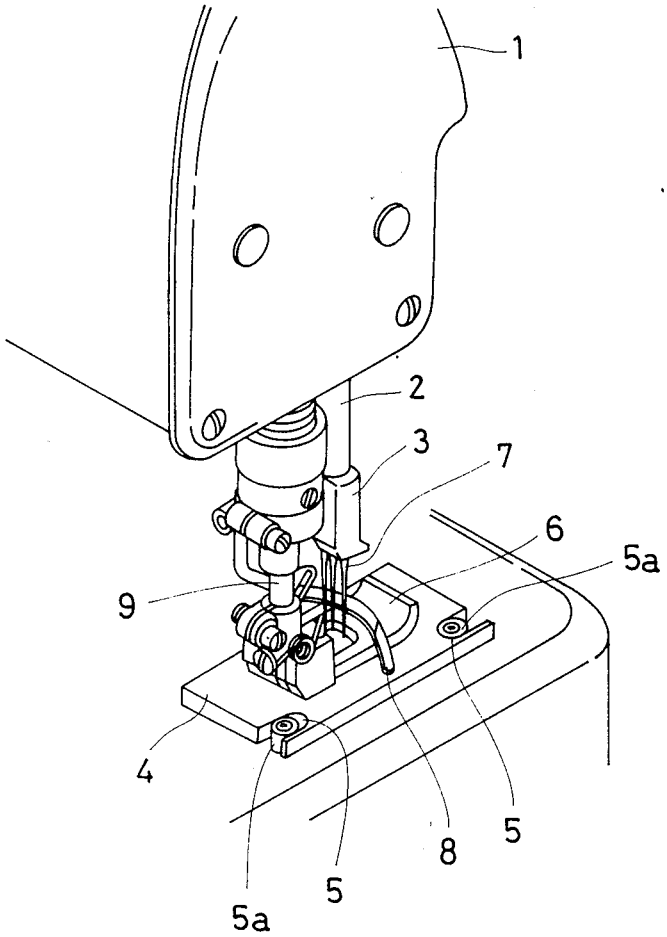
FIG. 1 is a perspective view of the stitch forming part of a flat sewing machine.
Figure 2:
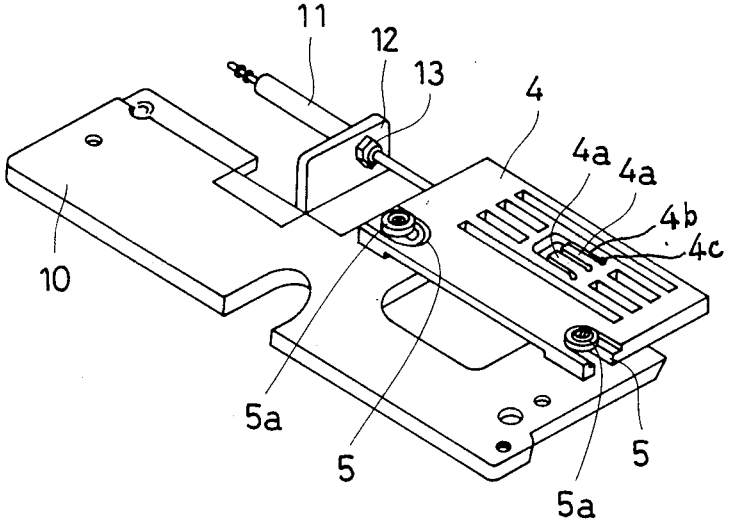
FIG. 2 is a perspective view of the part of FIG. 1 where a throat plate is moved in a direction contrary to the sewing direction by the action of a cylinder.
Figure 3:
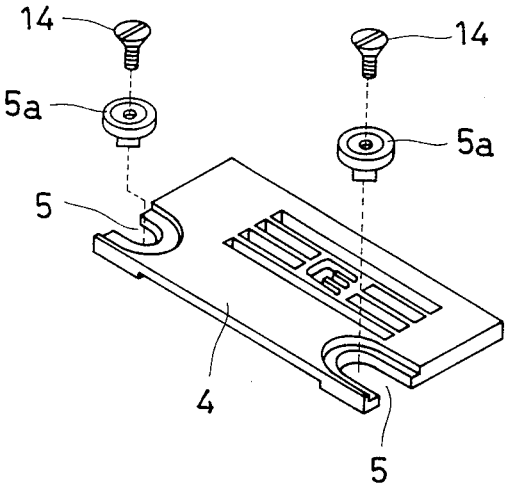
FIG. 3 is a perspective view of the part of FIG. 1 where rollers are fitted loosely in holes of slot shape made in the throat plate.
Figure 4:
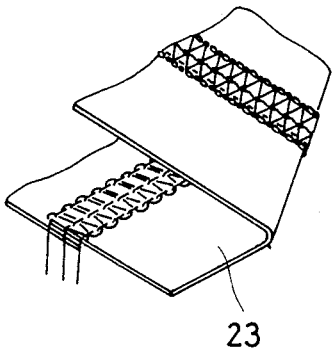
FIG. 4 shows seams made by a sewing machine according to the present invention.
Figure 5:
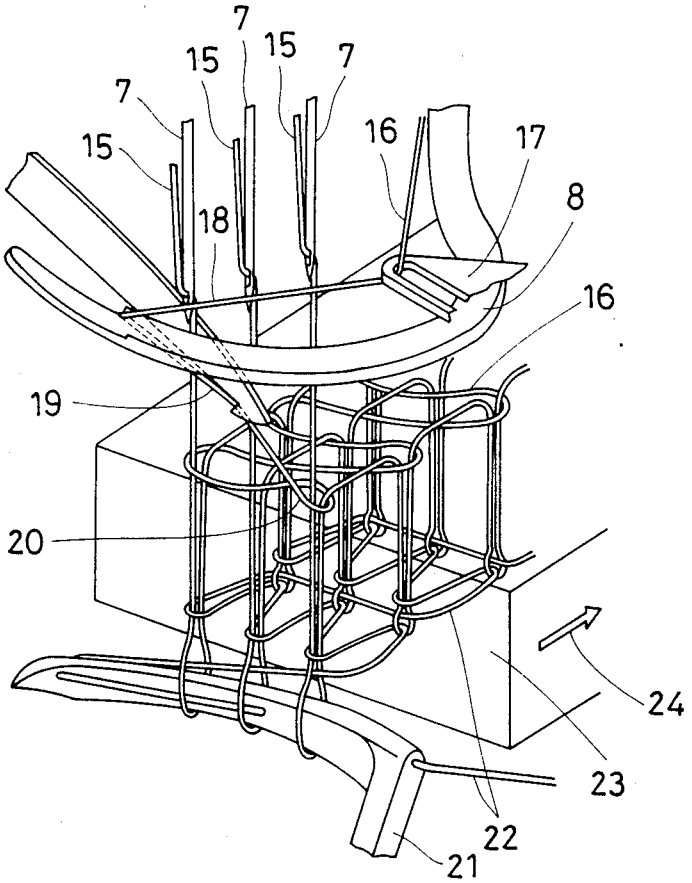
FIG. 5 shows how the seams shown in FIG. 4 are constructed.
Figure 6:
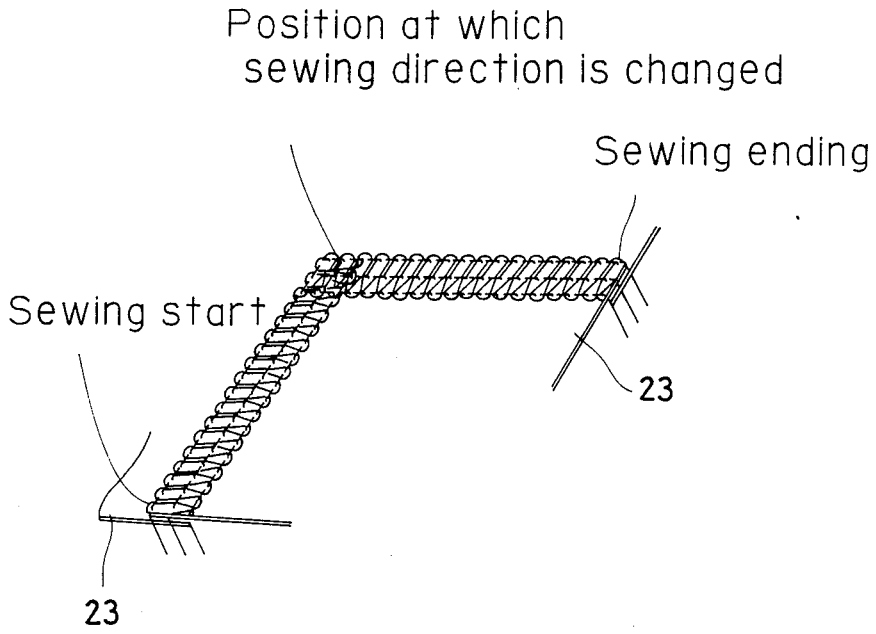
FIG. 6 shows how the sewing direction is changed at a right angle in relation to the sewing direction at sewing start and sewing was continued.
Figure 7:
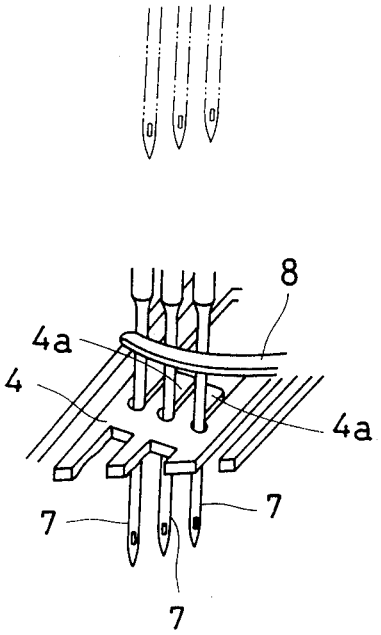
FIG. 7 is a perspective view of multiple needles in the state where needles are at the lower dead point center.
Figure 8:
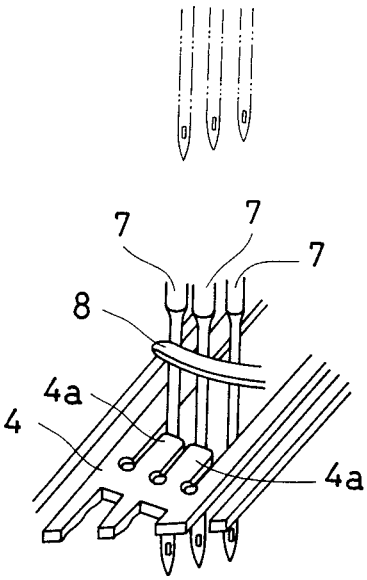
FIG. 8 is a perspective view of the multiple needles in the state where the throat plate is moved in a direction contrary to the sewing direction when the needles are at the needle upper dead center point and needles are out of needle drop holes.

An embodiment of the present invention is described below, with reference to the accompanying drawings.

Numeral 1 designates a sewing machine arm portion. Numeral 2 designates a needle bar. Numeral 3 designates a needle clamp. Numeral 4 designates a throat plate having tongues 4*a* with slots 4*b* therebetween having needle drop holes 4*c* at the inner ends thereof--after "4*a*". The conventional throat plate is fixed to the bed by screwing screws into holes, but in the present invention slots 5 of slot shape are made at both ends of the throat plate and rollers 5*a* are fitted loosely in the slots 5 so that the throat plate 4 can be moved in a direction contrary to the sewing direction by a pressing means, with cooperative working of the rollers 5*a*. Numeral 6 designates a presser foot. Numeral 7 designates multiple needles. Numeral 8 designates an ornamental thread looper. Numeral 9 designates a presser bar of the presser foot 6. Numeral 10 designates a presser foot fitting plate provided on a sewing machine head. The rollers 5*a* are fitted revolvably to the presser foot fitting plate by means of roller mounting screws 14. Numeral 11 designates a cylinder with its piston rod contacting the throat plate 4 so that the throat plate can be moved in a direction contrary to the sewing direction by the action of the cylinder 11. Numeral 12 designates a cylinder bracket for mounting the cylinder 11. Numeral 13 designates a set screw for adjusting the position of the cylinder and for fixing the cylinder. Numeral 15 designates a plurality of needle threads. Numeral 16 designates ornamental thread. Numeral 17 designates an ornamental thread eyelet side. Numeral 18 designates an ornamental thread on the thread eyelet side. Numeral 19 designates an ornamental thread on the sewing finishing side. Numeral 20 designates a sewing finishing part of ornamental thread. Numeral 21 designates a looper through which looper thread 22 is passed. Numeral 23 designates a material being sewn. Numeral 24 designates an arrow showing the sewing direction of a material being sewn.

The present invention is composed as mentioned above. In using a sewing machine according to the present invention, a material to be sewn 23 is inserted between the upper surface of the throat plate 4 and the undersurface of the presser foot 6 and when a foot treadle is pressed, the presser foot 6 descends and presses the material to be sewn 23, whereupon the sewing machine starts the usual sewing operation. In the course of the sewing operation, when the material being sewn 23 reaches the position where the angle of sewing direction is to be changed, the foot treadle is treadled back to be put in a neutral state, whereupon the sewing machine stops its sewing operation, the presser foot ascends, the material being sewn 23 is released from being pressed and, at the same time, needles are stopped at a needle top dead center position stop by a conventional needle driving motor which can be stopped at a desired position. Then, if the foot switch (not shown in the drawings) is operated, the cylinder 11 starts operation by pneumatic action and the piston rod of the cylinder 11 presses an end of the throat plate 4 so as to mvoe the throat plate 4 in a direction contrary to the sewing direction and to release thread caught by the tongues 4*a* of the throat plate 4. Thus, the material being sewn 23 is placed in a free state and is changed to the desired sewing angle for further sewing.

In the above embodiment, action by the pneumatic driving means is described but any other known driving means (for example, electric driving by a solenoid) can be adopted.

What is claimed is:

1. A method of changing a direction in which a multiple needle flat sewing machine sews a material, comprising:

moving a throat plate having tongues thereon in a direction contrary to said sewing direction when the needles are stopped at a needle upper dead center point, whereupon thread caught by the tongues of said throat plate is released from the tongues;

then changing the direction in which the material is being sewn at a desired angle.

2. A method as claimed in claim 1 in which said throat plate further has needle drop holes between said tongues, and further comprising moving said throat plate gradually to a position where said needle drop holes are located beneath said needles for sewing,and then moving the material being sewn rearwardly in relation to the sewing direction.

3. An apparatus for changing the direction in which a multiple needle flat sewing machine sews a material, comprising:

a throat plate having tongues thereon;

said throat plate having guide slots therein extending in a direction contrary to said direction of sewing;

rollers mounted on said sewing machine and rotatably engaged in said slots and guiding said throat plate during movement in said sewing direction;

means for reciprocally driving the needles of said sewing machine and stopping said needles at an upper dead center position; and a pressing means engaging said throat plate for moving said throat plate in said sewing direction when said needles are at the upper dead center position, whereby thread caught by the tongues on said throat plate is released from the tongues and the direction in which a material is being sewn can be changed at any desired angle.

* * * * *